United States Patent [19]

Lovelock et al.

[11] Patent Number: 4,674,637

[45] Date of Patent: Jun. 23, 1987

[54] DOCUMENTS FILING SYSTEMS

[75] Inventors: Richard K. Lovelock, Emsworth; Clive S. Smith, Weston on the Green, both of England

[73] Assignee: Dahle Design Ltd., Oxon, England

[21] Appl. No.: 643,850

[22] Filed: Aug. 24, 1984

[30] Foreign Application Priority Data

Aug. 24, 1983 [GB] United Kingdom ..... 8322804

[51] Int. Cl.[4] ..... A47F 5/00

[52] U.S. Cl. ..... 211/46; 312/184

[58] Field of Search ..... 211/45, 46, 47, 48, 211/94, 162; 312/183, 184

[56] References Cited

U.S. PATENT DOCUMENTS

| | | | |
|---|---|---|---|
| 2,339,447 | 1/1944 | Zwickel | 211/46 |
| 3,519,140 | 7/1970 | Wellman | 211/162 |
| 3,726,409 | 4/1973 | Skousen | 211/46 |
| 3,790,242 | 2/1974 | Sullivan | 312/184 |
| 4,105,268 | 8/1978 | Elias et al. | 312/184 |
| 4,300,692 | 11/1981 | Moreno | 211/94 X |
| 4,420,083 | 12/1983 | Bardes | 211/46 |

*Primary Examiner*—Robert W. Gibson, Jr.
*Attorney, Agent, or Firm*—Parkhurst & Oliff

[57] ABSTRACT

A document filing system including a document holder (1) provided along the top edge (3) thereof with retaining means (4) arranged to engage in complementary shaped supporting means (8), the release of the holder (1) and associated retaining means (4) from the said supporting means (8) being effected by relative movement between the retaining (4) and supporting means (8) in a direction normal to that required to locate the holder (1) and associated retaining means (4) on said supporting means (8).

11 Claims, 6 Drawing Figures

DOCUMENTS FILING SYSTEMS

BACKGROUND OF THE INVENTION

This invention relates to document filing systems and particularly to a suspended filing system.

SUMMARY OF THE INVENTION

An object of the invention is to provide a document filing and storage system in which documents such as plans, drawings and the like may be located in a document holder and suspended from supporting means such as to provide ease of access and retrieval.

According to one aspect of the invention there is provided a document filing system including a document holder provided along the top edge thereof with retaining means arranged to engage in complementary shaped supporting means, the release of the holder and associated retaining means from the said supporting means being effected by relative movement between the retaining and supporting means in a direction normal to that required to locate the holder and associated retaining means on said supporting means.

According to a further aspect of the invention there is provided a document holder having a channel-section member being adapted to engage with a complementary shaped channel section supporting member such as to support the document holder.

In a preferred embodiment of the invention, the document holder consists of a transparent envelope preferably of plastics material, e.g. polythene which may be formed with a flap and of the self-adhesive type to allow documents such as plans, drawings, pamphlets leaflets and like material to be stored within the envelope. The top edge of the envelope is provided with a plastics extrusion preferably of a synthetic thermoplastic resinous material, e.g. polypropylene, and the extrusion is of channel-section having one wall of greater depth than the other, the former being secured to the envelope and the latter being used as the retaining means for locating the envelope and documents contained therein on a supporting member. This supporting member preferably comprises a further polypropylene extrusion having a shape complementary to that of the retaining extrusion such that the two extrusions may be snapped together to interlock the retaining member, and the supporting member; the channel-section configuration of each extrusion allowing the retaining extrusion to be slid with respect to the supporting extrusion when it is required to remove or retrieve the document holder from storage.

BRIEF DESCRIPTION OF THE DRAWINGS

The invention will now be described by way of example only with particular reference to the accompanying drawings showing various arrangements for suspending document holders from a in which.

DETAILED DESCRIPTION OF THE INVENTION

Figure 2:
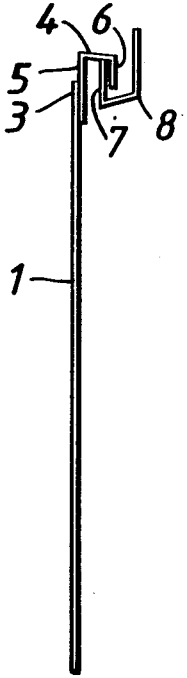
FIG. 2 is an end view of the holder suspended from the supporting extrusion.
Figure 1:
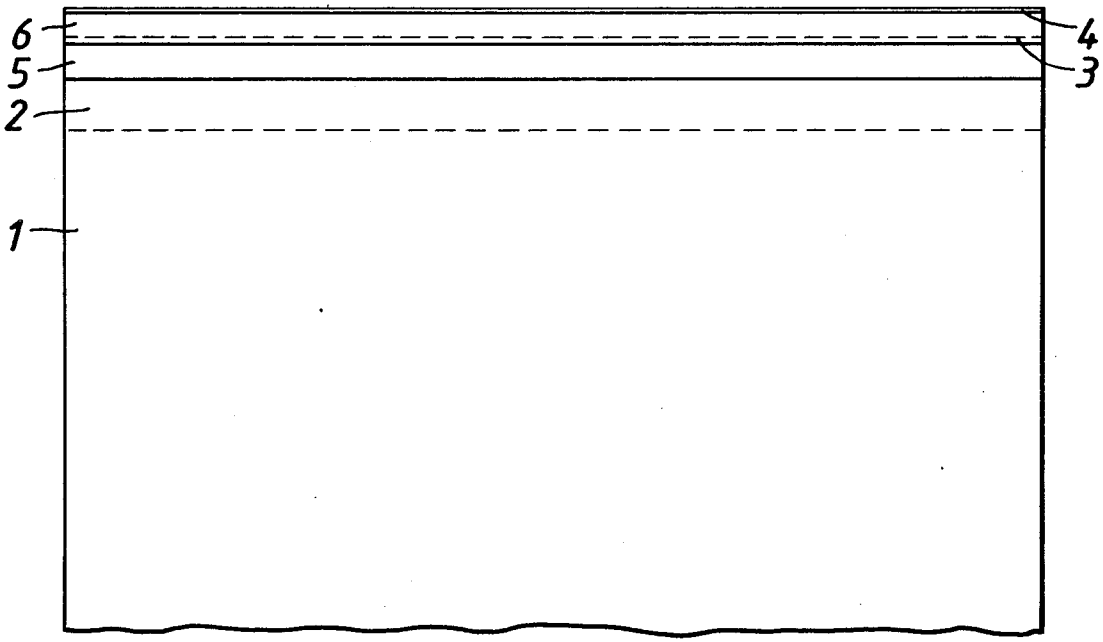
FIG. 1 is a plan view of the document holder.

Referring to FIG. 1, the document holder comprises a transparent envelope 1 preferably of polythene, having a flap 2. The top edge 3 has secured thereto a plastic extrusion 4, preferably of polypropylene and having the channel section shown in FIG. 2. The deeper wall 5 of the extrusion 4 is secured to the envelope 1 whilst the shallow wall 6 of the extrusion 4 snaps over the shallow wall 7 of a complementary-shaped extrusion 8 constituting the supporting means.

Figure 3:
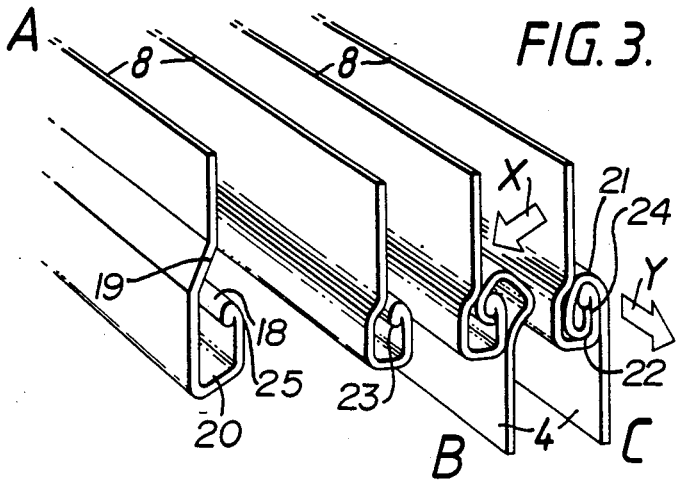
FIG. 3 indicates the method of retaining and releasing the retaining and supporting extrusions.

The actual shape of the supporting extrusion 8 is shown in FIG. 3 at A.

The deeper wall of the supporting extrusion 8 extends downwardly and away from the shallow wall of the extrusion 8, to define the first inwardly facing engagement surface 19. The top of the shallow wall carries an inturned web 25 which defines an inturned abutment 23 along its inner extremity. The upwardly facing surface of a member joining the lower extremities of the walls of the extrusion 8 defines the second inwardly facing engagement surface 20. The entrance slot 18 is defined between the first inwardly facing engagement surface 19 and the inturned web 25.

The retaining extrusion 4 has a complementary shape to the supporting extrusion 8. As shown in FIGS. 3C and 4C, a first outwardly facing engagement surface 21 is defined by the upper surface of a portion of the retaining extrusion 4 extending between the upper ends of the walls 5 and 6. The lower extremity of the shallow wall 6 is in the form of an inturned web 24, the lower and outer surface of which defines a second outwardly facing engagement surface 22. The upwardly facing portion of the inturned web provides a complementary abutment 26.

FIG. 3 at B and C illustrates the manner in which the two extrusions 4, 8 are engaged and disengaged. In order to engage the two extrusions 4, 8 the inturned web of the retaining extrusion is fed downwardly through the slot 18 in the direction of arrow X, until the extrusions 4, 8 snap into rigid interlocking engagement, with the first inwardly facing engagement surface 19 engaging the first outwardly facing engagement surface 21 and the second inwardly facing engagement surface 20 engaging the second outwardly facing engagement surface 22. In order to disengage the extrusions 4, 8 the retaining extrusion 4 is slid out of the supporting extrusion 8 in the direction of arrow Y.

Figure 4:
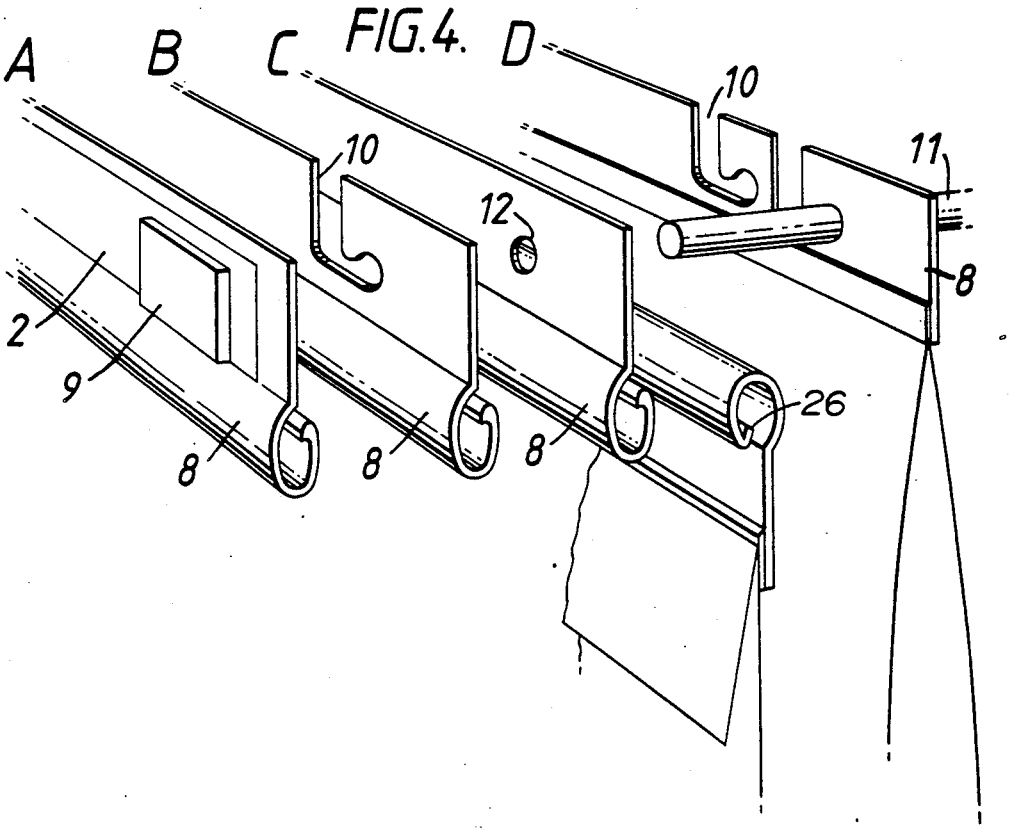
FIG. 4 indicates various ways of supporting the supporting extrusion.
Figure 5:
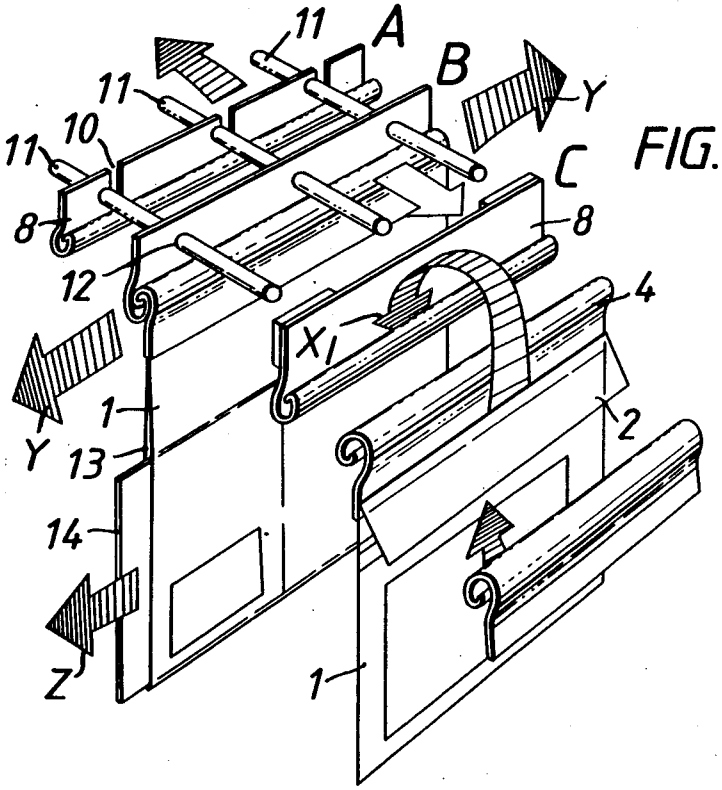
FIG. 5 at A, B and C indicates the method of retaining and releasing the retaining and supporting extrusions of FIG. 4.

In FIG. 4 at A to D, various alternative means are provided for securing the supporting extrusion 8 to a surface or support. In FIG. 4 at A, an adhesive pad 9 is attached to extrusion 8 to allow the extrusion to be mounted on a planar surface. In FIG. 4 at B the upper edge of extrusion 8 is notched as shown at 10, to allow the extrusion 8 to be supported from rails 11 as shown at D in FIG. 4. Similarly extrusion 8 is provided with holes 12 as shown at C in FIG. 4 to allow the rails 11 to pass therethrough and hold the extrusions 4 and 8 and the document holder suspended as shown in FIG. 4 at A and B. FIG. 5 at C shows the extrusion 8 of FIG. 4 at A with adhesive pads 9 and the document holder 1 with extrusion 4 for attachment thereto as shown by arrow $X_1$.

As shown in FIG. 5 at B, the envelope 1 may be provided with an opening 13 along one lateral edge to allow the contents 14 to be removed in the direction of arrow Z.

Figure 6:
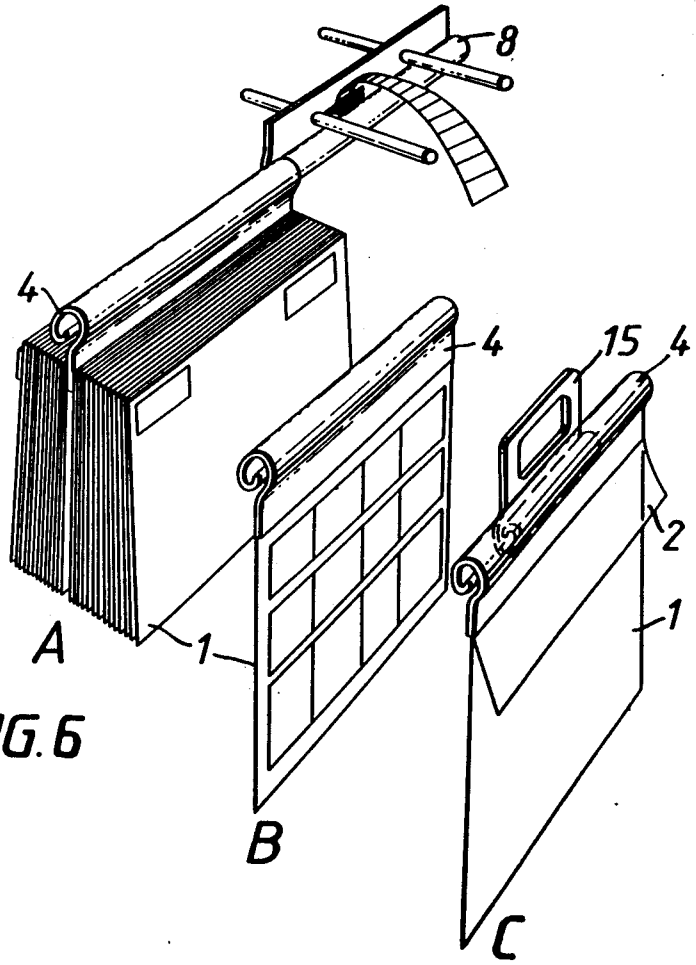
FIG. 6 illustrates various types of document holder.

It will be appreciated that the invention is susceptible to considerable modification and is not to be deemed limited to the particular details illustrated. In FIG. 4 at A, the supporting extrusion 8 is shown of cylindrical form and the extrusion 4 is shown carrying a multi-leaved document holder 1. As shown at C in FIG. 6, the retaining extrusion 4 is provided with a carrying handle 15 attached thereto or formed integrally therewith to allow the documents to be transported with ease.

We claim:

1. A document filing system, comprising:

a document holder provided along the top edge thereof with channel section retaining means arranged to engage in complementary shaped supporting means, said supporting means defining an entrance slot and first and second inwardly facing engagement surfaces;

said retaining means including engagement means defining first and second outwardly facing engagement surfaces; and said engagement means being arranged to be fed through the slot and snapped into a rigid inter-locking engagement with the supporting means such that the first inwardly facing engagement surface engages the first outwardly facing engagement surface and the second inwardly facing engagement surface engages the second outwardly facing engagement surface, said engagement means being releasable from said supporting means by sliding the retaining means relative to the supporting means.

2. A document filing system as claimed in claim 1, wherein said supporting means further comprises an inwardly turned abutment adjacent to said entrance slot, and said engagement means carries a complementary abutment, said complementary abutment being adapted to engage said inwardly turned abutment when said engagement means is in rigid inter-locking engagement with the supporting means.

3. A document filing system as claimed in claim 2, wherein the retaining means and the supporting means each comprise resilient extrusions of a synthetic thermoplastic resinous material.

4. A document filing system as claimed in claim 3, wherein the document holder comprises an envelope of a transparent plastic material.

5. A document filing system as claimed in claim 4, wherein the transparent plastic material is polythene.

6. A document filing system as claimed in claim 1, wherein the supporting means is provided with means for securing the supporting means to a planar surface.

7. A document filing system as claimed in claim 2, wherein the supporting means is provided with means for suspending the supporting means from rails.

8. A document filing system as claimed in claim 2, wherein said channel section retaining means is provided with a carrying handle.

9. A document filing system as claimed in claim 2, further comprising a transparent envelope having the channel section retaining means secured to the top edge thereof.

10. A document filing system as claimed in claim 4 wherein the envelope is provided with an opening along at least one lateral edge to allow the contents to be inserted in and removed from the envelope.

11. A document filing system as claimed in claim 3, wherein said resinous material is polypropylene.

* * * * *